US006572341B2

(12) United States Patent
Kimura et al.

(10) Patent No.: US 6,572,341 B2
(45) Date of Patent: Jun. 3, 2003

(54) VARIABLE DISPLACEMENT TYPE COMPRESSOR WITH SUCTION CONTROL VALVE

(75) Inventors: Kazuya Kimura, Kariya (JP); Masahiro Kawaguchi, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/775,965

(22) Filed: Feb. 2, 2001

(65) Prior Publication Data

US 2001/0024616 A1 Sep. 27, 2001

(30) Foreign Application Priority Data

Feb. 4, 2000 (JP) ..... 2000-028200

(51) Int. Cl.[7] ..... F04B 49/00

(52) U.S. Cl. ..... 417/213; 417/270; 251/129.02; 251/129.15

(58) Field of Search ..... 417/213, 222.2, 417/269, 270, 218, 274; 251/129.02, 129.15; 92/71

(56) References Cited

U.S. PATENT DOCUMENTS

| | | | | |
|---|---|---|---|---|
| 4,730,986 A | * | 3/1988 | Kayukawa et al. | 417/222.2 |
| 5,312,085 A | * | 5/1994 | Yokoyama et al. | 251/121 |
| 5,529,461 A | * | 6/1996 | Kawaguchi et al. | 417/222.2 |
| 5,681,150 A | * | 10/1997 | Kawaguchi et al. | 417/222.2 |
| 5,785,502 A | * | 7/1998 | Ota et al. | 417/222.2 |
| 5,797,730 A | | 8/1998 | Kawaguchi et al. | 417/222.2 |
| 5,871,337 A | * | 2/1999 | Fukanuma et al. | 417/222.2 |
| 5,988,988 A | * | 11/1999 | Tokumasu | 417/222.2 |
| 6,142,745 A | * | 11/2000 | Kawaguchi et al. | 417/222.2 |
| 6,149,397 A | * | 11/2000 | Mizutani et al. | 417/222.2 |
| 6,203,284 B1 | * | 3/2001 | Kawaguchi et al. | 417/222.2 |
| 6,247,322 B1 | * | 6/2001 | Ban et al. | 62/228.3 |

FOREIGN PATENT DOCUMENTS

| | | | |
|---|---|---|---|
| JP | 4-321779 | * | 11/1992 |
| JP | A-6-123281 | | 5/1994 |
| JP | 9-145172 | * | 6/1997 |
| JP | A-9-145172 | | 6/1997 |
| JP | 09145172 A | * | 6/1997 |
| JP | A-10-141221 | | 5/1998 |
| JP | 10-141242 | * | 5/1998 |
| JP | 10-141242 A | * | 5/1998 |
| JP | 11-223183 A | * | 8/1999 |

* cited by examiner

*Primary Examiner*—Charles G. Freay
*Assistant Examiner*—Han L. Liu
(74) *Attorney, Agent, or Firm*—Woodcock Washburn LLP

(57) ABSTRACT

A variable displacement type compressor has a tiltable swash plate and pistons in cylinder bores. The displacement of the compressor is controlled by changing an inclination angle of the swash plate. A first valve is arranged to open and close the suction passage in response to the pressure in the discharge chamber. The valve element of the first valve is arranged to face the end of the suction passage, and can hermetically close the suction passage when the refrigerant gas is introduced into the pressure chamber from the discharge chamber. The refrigerant gas can be also introduced into the crank chamber when the refrigerant gas is introduced from the discharge chamber into the pressure chamber.

16 Claims, 6 Drawing Sheets

15
Crank Chamber
35
Suction Chamber
34
Discharge Chamber
13a
13b
36
49
50
50a
51
52
53
54
55
56
57
58
59
60
31
33
42a
43a
44
45
46
47
48

VARIABLE DISPLACEMENT TYPE COMPRESSOR WITH SUCTION CONTROL VALVE

BACKGROUND OF THE INVENTION

1. Field of the Invention

The present invention relates to a variable displacement type compressor. More particularly, the present invention relates to a variable displacement type compressor used for an air conditioner incorporated in a vehicle, for example.

2. Description of the Related Art

In general, a refrigerating circuit of an air conditioner for a vehicle includes a condenser, an expansion valve, an evaporator and a compressor. The compressor sucks refrigerant gas from the evaporator, compresses it and discharges the thus compressed refrigerant gas to the condenser. In the evaporator, heat exchange is conducted between the refrigerant flowing in the refrigerating circuit and the air flowing into the passenger compartment.

In general, the compressor mounted on the vehicle is driven by the power of the engine of the vehicle, and the power of the engine is used by the compressor when the air conditioner of the vehicle is operated. Accordingly, when the vehicle is accelerated or the vehicle is driven while it is climbing a hill and when a heavy load is required for the compressor, the power of the engine becomes insufficient and the acceleration performance or the driveability of the vehicle is deteriorated. In order to solve the above problems, there is provided a variable displacement type compressor which can be driven in a small-capacity condition when the vehicle requires a higher power for running.

The variable displacement swash plate type compressor, which is commonly used as a compressor mounted on the vehicle, includes a plurality of cylinder bores, a crank chamber, a suction chamber and a discharge chamber formed in the housing of the compressor, pistons being reciprocatingly arranged in the cylinder bores. A drive shaft to which the power is transmitted from the engine (external drive source) of the vehicle is provided through the crank chamber. A rotary support body (lug plate) fixed to the drive shaft is operatively connected to the swash plate (cam plate) via a hinge mechanism (connection guide mechanism). The swash plate, converting a rotary motion of the drive shaft into a reciprocating motion of the pistons, can rotate with the drive shaft and can tilt with respect to the drive shaft while the swash plate is slid in the axial direction of the drive shaft. A stroke of the reciprocation of the pistons, that is, a displacement or a discharge capacity is determined by the inclination angle of the swash plate. However, the inclination of the swash plate is mainly determined by a difference between the pressure in the crank chamber controlled by the capacity control valve and the pressure in the cylinder bore, which act on opposite sides of the pistons.

In the variable displacement type compressor, in the case where the compressor is continuously driven under the condition that the peripheral temperature is low, there is a possibility that the evaporator is frozen. In order to prevent the occurrence of freezing, it is necessary to stop the operation of the compressor. It is a conventional technique that the power of the engine is transmitted to the drive shaft (rotary shaft) of the compressor via an electromagnetic clutch and that the compressor is driven via the electromagnetic clutch in the case of cooling and dehumidifying. However, problems are caused in the compressor having the electromagnetic clutch, because the manufacturing cost of the compressor is high and further the weight of the compressor is heavy. In order to solve the above problems, Japanese Unexamined Patent Publication No. 9-145172 discloses a vapor compression type refrigerating machine into which a variable displacement swash plate type compressor is incorporated, wherein a flow control valve for shutting off the flow of refrigerant or reducing a flow rate of refrigerant is arranged in the middle of the refrigerant passage provided between the outlet of the evaporator and the suction chamber (low pressure chamber) of the compressor.

As shown in FIG. 6 of the attached drawings, a flow control valve 70 is arranged in a valve holding hole 73 formed between a suction port 71 connected to an outlet of an evaporator (not shown) and a low pressure chamber (suction chamber) 72. The flow control valve 70 includes a valve casing 74, a valve element 75 and a compression spring 76. The valve casing 74 is arranged perpendicular to a suction passage 77 and includes an inlet port 78 for communication with the suction port 71, and an outlet port 79 for communication with the low pressure chamber 72. The valve element 75 is urged to the open side by the compression spring 76. When the pressure in the discharge chamber is supplied to the pressure chamber 80, the valve element 75 is moved to a closed position. In the middle of the passage connecting the pressure chamber 80 to a discharge chamber, there is provided an electromagnetic opening and closing valve.

In the case where it is unnecessary to cool the evaporator, for example, in winter, the electromagnetic opening and closing valve is opened, so that the valve element 75 is kept at a closed position. In this connection, there is provided a small clearance between the inner circumferential surface of the valve casing 74 and the outer circumferential surface of the valve element 75, and therefore, a small quantity of refrigerant vapor and lubricant flows through this clearance. Accordingly, the quantity of refrigerant sucked from the evaporator into the compressor becomes very small, and there is no possibility that the evaporator is frozen even if the operation of the compressor is not stopped. As a result, it is possible to omit the electromagnetic clutch.

However, in the above conventional device, when the suction passage 77 is closed, it is not completely closed but the small clearance is formed between the valve casing 74 and the valve element 75 so that a small quantity of refrigerant gas and lubricant can flow through it. However, in the case where a quantity of refrigerant gas is reduced to a value at which the evaporator is not frozen while the refrigerant gas discharged from the compressor is flowing in the circulating circuit from the external refrigerant circuit including the evaporator to the compressor, it is difficult for the lubricant, which is discharged from the compressor into the external refrigerant circuit together with the refrigerant, to return to the compressor together with the refrigerant. As a result, when the compressor is continuously operated over a long period of time in winter, the quantity of lubricant accommodated in the crank chamber becomes insufficient, and there is a possibility that the sliding sections in the crank chamber seize up and deteriorate early.

In the structure of the flow control valve 70 disclosed in the above patent publication, the valve element 75 is arranged to move between the open position and the closed position, crossing the suction passage 77. Therefore, under the condition that the valve element 75 is located at the closed position, refrigerant gas flows from the suction port 71 to the low pressure chamber 72 via the clearance formed for the valve element 75 to slide in the valve casing 74. As a result, even if the clearance is not positively provided, it is impossible to reduce the quantity of refrigerant gas returning to the compressor via the external refrigerant circuit to zero, that is, lubricant is gradually removed from the compressor. As a result, the quantity of lubricant in the compressor becomes insufficient.

SUMMARY OF THE INVENTION

The present invention is made to solve the above problems, and the object of the present invention is to provide a variable displacement type compressor, by which an evaporator in an external refrigerant circuit is not frozen even if the operation of the compressor is continuously conducted at a minimum displacement state, and it is possible to prevent the compressor from falling into an insufficiently lubricating condition.

According to the present invention, there is provided a variable displacement type compressor comprising: a housing having cylinder bores, a crank chamber, a suction chamber and a discharge chamber formed therein; a suction passage for introducing refrigerant gas from an outer refrigerant circuit into the suction chamber; a discharge passage for discharging refrigerant gas from the discharge chamber to the outer refrigerant circuit; pistons slidably arranged in the cylinder bores; a drive shaft extending through the crank chamber; a cam plate mounted on the drive shaft for rotation with the drive shaft, tiltable with respect to the drive shaft and operatively coupled to the pistons to convert the rotation of the drive shaft into the reciprocating motion of the pistons; a pressure control device for controlling the pressure in the crank chamber to change an inclination angle of the cam plate to change the displacement of the compressor; a first valve arranged in the suction passage for opening and closing the suction passage, the first valve having a valve element and a pressure chamber applying a pressure to the valve element, the first valve being arranged such that the valve element can hermetically close the suction passage when the refrigerant gas is introduced into the pressure chamber; a first passage for introducing the refrigerant gas from the discharge chamber into the pressure chamber; a second passage branched from the first passage at a branch point and leading to the crank chamber; and a control device arranged such that the refrigerant gas can be introduced from the second passage into the crank chamber when the refrigerant gas is introduced from the discharge chamber into the pressure chamber and that the flow of the refrigerant gas from the crank chamber to the first passage is blocked when the introduction of the refrigerant gas from the discharge chamber into the pressure chamber is stopped.

The compressor of the present invention is used by being connected to an external refrigerant circuit. When it is unnecessary to compress refrigerant gas, by the compressor, the compressor is operated at the minimum displacement. In the operation at the minimum displacement, the discharged refrigerant gas is supplied from the discharge chamber to the pressure chamber of the first valve, and the first valve is moved to the closing position where the suction passage is tightly or hermetically closed. Accordingly, a flow of refrigerant gas from the external refrigerant circuit to the compressor is shut off, and refrigerant gas circulates in the compressor, so that lubricant is prevented from being taken away to the external refrigerant circuit. When it is necessary to compress refrigerant by the compressor, that is, in the case of the normal operation of the compressor, the supply of the discharged refrigerant gas to the pressure chamber is stopped, and communication between the crank chamber and the pressure chamber of the first valve is shut off, so that the first valve can be opened. Then, refrigerant gas compressed by the compressor is discharged from the discharge chamber to the external refrigerant circuit and returned from the suction passage to the compressor via the external refrigerant circuit.

Preferably, the control device comprises an electromagnetic valve arranged in the first passage between the branch point and the discharge chamber and a check valve arranged in the second passage.

In this arrangement, when the electromagnetic valve provided in the first passage is opened, discharged refrigerant gas is supplied from the discharge chamber to the pressure chamber of the first valve. A portion of the discharge gas is supplied into the crank chamber via the check valve in the second passage. When the electromagnetic valve is closed, the supply of discharge gas into the pressure chamber and the crank chamber via the first and second passages is stopped. Accordingly, it is possible to simplify the structure of the control device for supplying and stopping discharge gas to the pressure chamber and the crank chamber.

Preferably, the housing has a wall having a surface and a port formed through the wall and opening at the surface, the port constituting a portion of the suction passage, the valve element of the first valve being arranged to face the surface and movable in the direction perpendicular to the surface, the pressure chamber being arranged on the side of the valve element remote from the surface of the wall.

In this arrangement, the valve element closes the suction passage under the condition that the valve element comes into contact with the surface of the wall which forms the suction passage. Clearance necessary for the valve element to be moved is independent of a portion of the valve where the suction passage is closed. Accordingly, the suction passage can be tightly closed by a simple structure.

In this case, preferably, the first valve includes a valve housing in which the valve element is slidably arranged, the valve element having a front end extending from the valve housing and abutting against the surface of the wall when the first valve is in the closed position, the valve element having a back end arranged in the valve housing, the pressure chamber being formed by the back end of the valve element and the valve housing.

Preferably, the first valve includes a spring urging the valve element in the valve open direction.

In this arrangement, when the supply of discharge gas to the pressure chamber is stopped, the valve can be opened by the action of the spring. As a result, no suction pressure loss is caused when the compressor is operated in the case of turning on the air conditioner.

Preferably, the first valve includes a spring urging the valve element in the valve close direction.

In this arrangement, even if the displacement (minimum displacement) in the case of turning off the compressor is reduced, it is possible to hold the valve element at a position where the suction passage is tightly closed.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
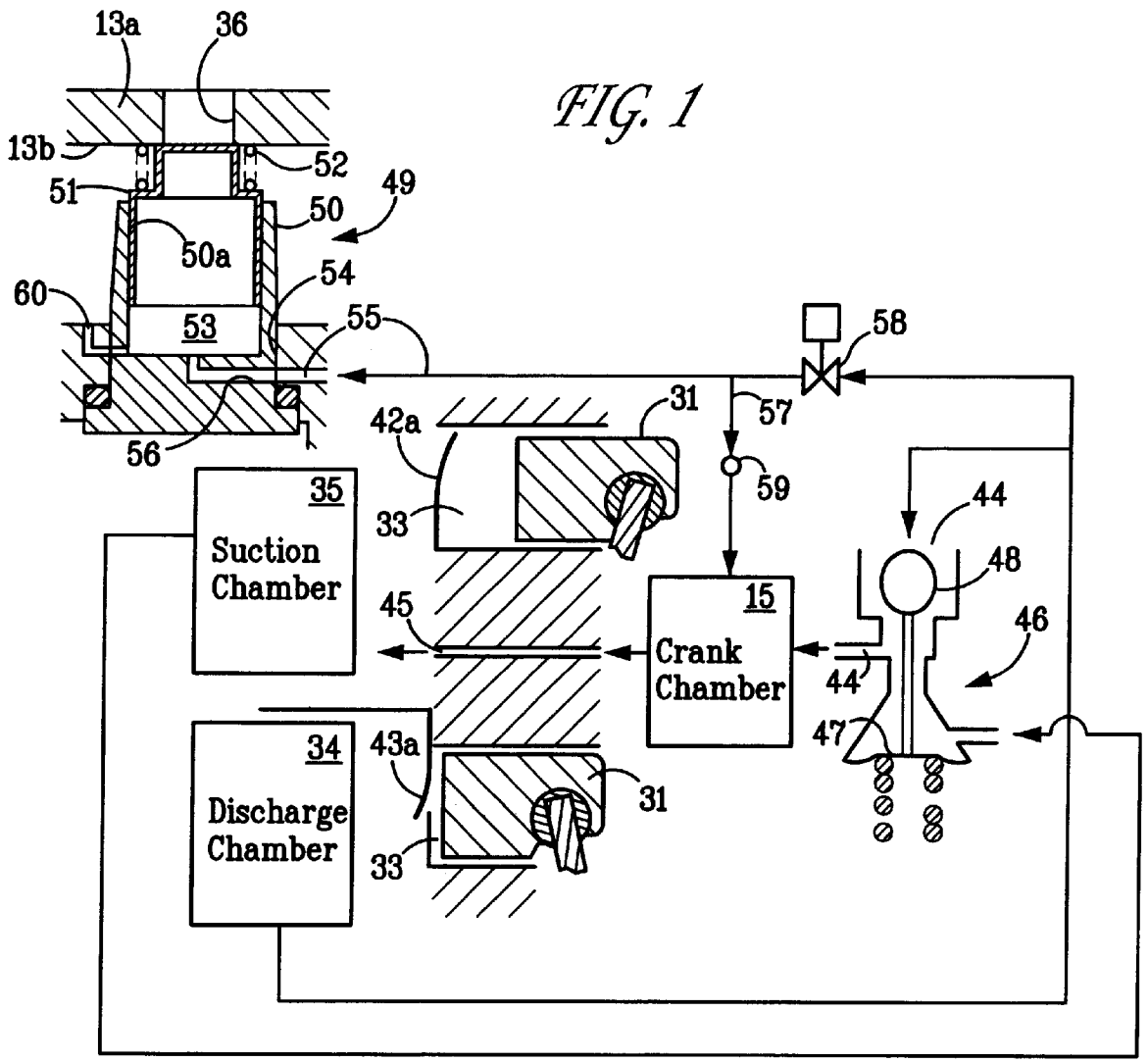
FIG. 1 is a schematic view showing a flow of refrigerant gas in a compressor of the embodiment of the present invention.
Figure 2:
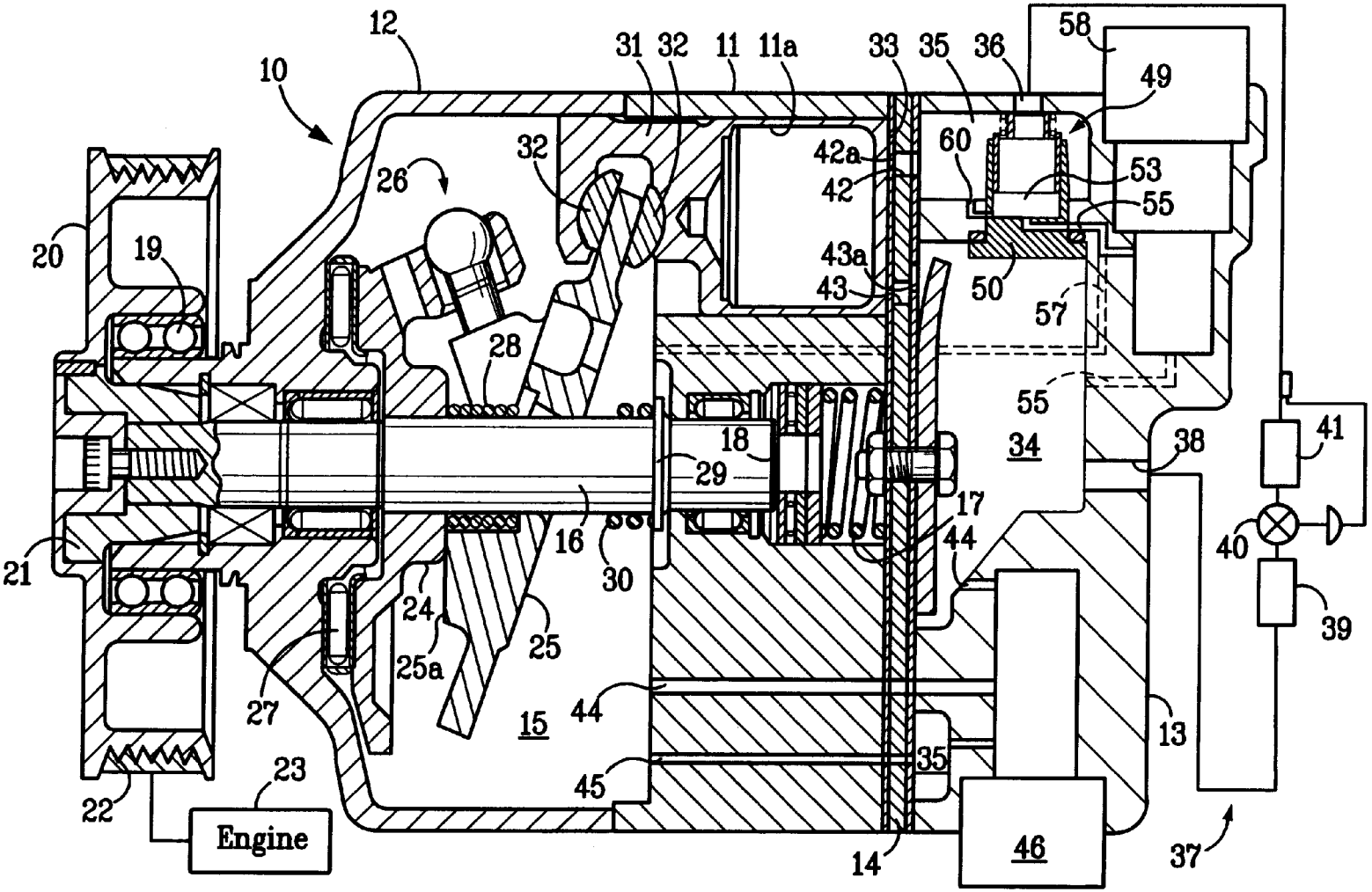
FIG. 2 is a cross-sectional side view of the compressor.
Figure 3:
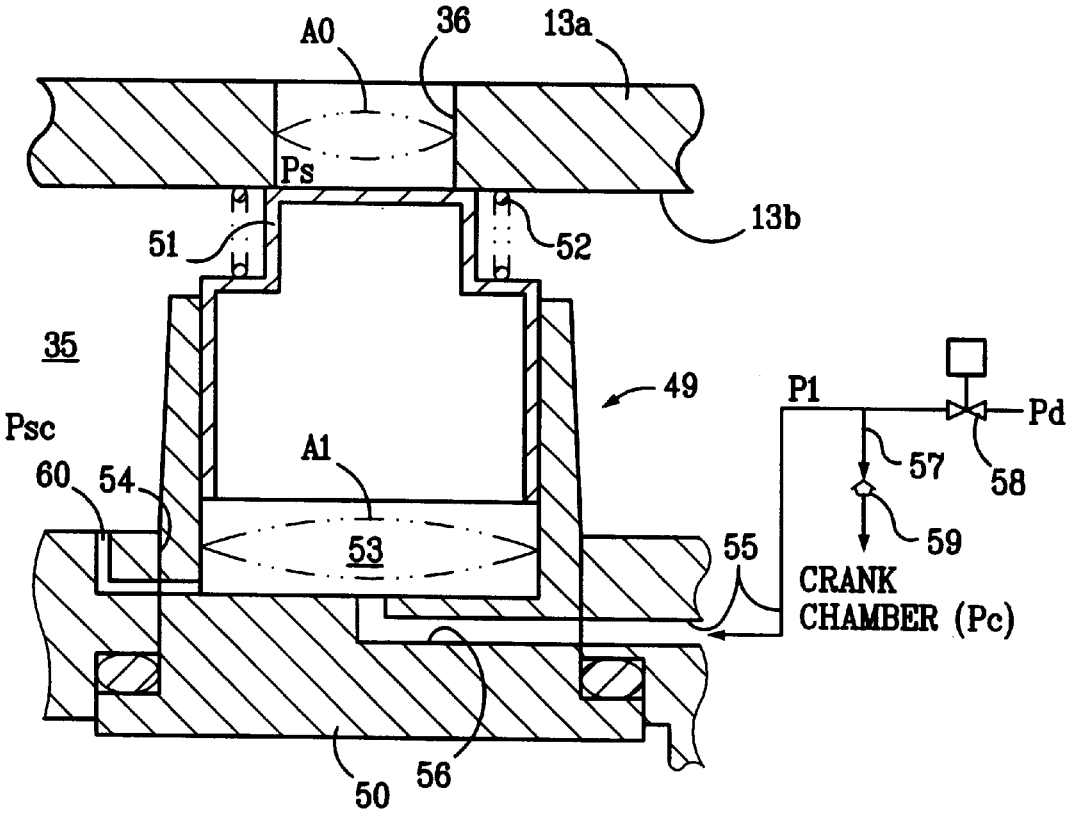
FIG. 3 is a cross-sectional view showing the suction control valve.

Referring to FIGS. 1 to 3, the embodiment of the present invention will be explained. As shown in FIG. 2, the variable displacement type compressor 10 includes a cylinder block 11, a front housing 12 connected to the forward end of the cylinder block 11 and a rear housing 13 connected to the rear end of the cylinder block 11 via a valve forming body 14. Both housings 12 and 13 and the cylinder block 11 are joined and fixed to each other by a plurality of through-bolts (not shown in the drawing) to form a housing of the compressor. A crank chamber 15 is formed in the housing at a region surrounded by the cylinder block 11 and the front housing 12.

A drive shaft 16 is rotatably supported by the front housing 12 and the cylinder block 11. A coil spring 17 and a thrust bearing 18 are arranged in an accommodating section formed at the center of the cylinder block 11. The rear end of the drive shaft 16 is supported by the thrust bearing 18 which is urged forward by the coil spring 17. A pulley 20 is rotatably supported by the forward cylindrical end section of the front housing 12 via an angular bearing 19. The pulley 20 is connected to the drive shaft 16 via a connecting member 21 so that the pulley 20 can be rotated conjointly with the drive shaft 16. The pulley 20 is connected to an engine 23 of a vehicle, which is a drive source, via a belt 22.

In the crank chamber 15, there are provided a rotary support body (lug plate) 24 attached to the drive shaft 16, a swash plate 25 as a cam plate, and a hinge mechanism 26 as a connecting guide mechanism between the lug plate 24 and the swash plate 25. The lug plate 24 comes into contact with the inner wall surface of the front housing 12 via a thrust bearing 27. The swash plate 25 is supported by the drive shaft 16 in such a manner that it can slide in the axial direction of the drive shaft 16 and also can tilt with respect to the drive shaft 16. By the lug plate 24 and the hinge mechanism 26, the swash plate 25 is capable of sliding and tilting with respect to the drive shaft 16, and capable of rotating with the drive shaft 16.

Between the lug plate 24 and the swash plate 25, there is provided an inclination angle decreasing spring 28 around the drive shaft 16. The inclination angle decreasing spring 28 urges the swash plate 25 in a direction such that the swash plate 25 can come close to the cylinder block 11, that is, the inclination angle decreasing spring 28 urges the awash plate 25 in a direction such that the inclination angle is decreased. A circlip 29 is fixed to the drive shaft 16 on the rear side of the swash plate 25. Between the circlip 29 and the swash plate 25, there is provided a return spring 30. When the return spring 30 is pushed by the swash plate 25, the return spring 30 resists the pushing force and urges the swash plate 25 in a direction so that the swash plate 25 can be separated from the cylinder block 11, that is, the return spring 30 urges the awash plate 25 in a direction so that the inclination angle is increased.

In the cylinder block 11, there are provided a plurality of cylinder bores 11*a* (only one cylinder bore is shown in the drawing) which are arranged around the drive shaft 16 at regular angular intervals. Each cylinder bore 11*a* extends in parallel to the drive shaft 16. In each cylinder bore 11*a*, a single headed type piston 31 is accommodated and is capable of reciprocating. The forward end of each piston 31 is engaged with the circumferential section of the swash plate 25 via a pair of shoes 32. In each cylinder bore 11*a*, a pressure chamber 33 is defined between the piston end surface and the valve body 14. When the swash plate 25, which is tilted, is rotated together with the drive shaft 16, the swash plate 25 conducts a waving motion, which causes a reciprocating motion of each piston 31 via the pair of shoes 32. In this structure, the swash plate 25 and the pair of shoes 32 compose a cam plate means for converting a rotational motion of the drive shaft 16 into a reciprocating motion of the piston 31.

In the rear housing 13, there are formed a discharge chamber 34 and a substantially annular suction chamber 33 which surrounds the discharge chamber 34. The suction chamber 35 is connected to the downstream side of an external refrigerant circuit 37 via a suction passage 36, and the discharge chamber 34 is connected to the upstream side of the external refrigerant circuit 37 via a discharge port 38. The external refrigerant circuit 37 includes a condenser 39, an expansion valve 40 and an evaporator 41.

In the valve forming body 14, there are formed a suction port 42 and a discharge port 43 which are provided for each pressure chamber 33. Also, there are formed a suction valve 42*a* and a discharge valve 43*a* which are provided corresponding to the ports 42 and 43. When the piston 31 conducts a sucking operation, refrigerant gas in the suction chamber 35 pushes the suction valve 42*a* to open and the gas is sucked into the pressure chamber 33. During the compressing motion of the piston 31, the compressed refrigerant gas pushes the discharge valve 43*a* to open and the gas is discharged into the discharge chamber 34.

In the cylinder block 11, the valve forming body 14 and the rear housing 13, there are provided a gas feed passage 44 connecting the crank chamber 15 to the discharge chamber 34, and an gas extraction passage 45 connecting the crank chamber 15 to the suction chamber 35, wherein the gas extraction path 45 has an orifice in the middle thereof. In the middle of the gas feed passage 44, there is provided a control valve 46. For example, the control valve 46 is composed in the same manner as that of the control valve disclosed in Japanese Unexamined Patent Publication No. 6-123281. The content thereof is incorporated herein by reference. That is, the control valve 46 includes a diaphragm 47 which is displaced according to a detection of the suction pressure, and a valve mechanism 48 (the appearance of which is shown in FIG. 1) for controlling the degree of opening of the gas feed path 44 according to the displacement of the diaphragm 47.

In the control valve 46, when the pressure in the suction chamber 35 is lower than a predetermined value, the diaphragm 47 is displaced and the gas feed passage 44 is opened, and when the pressure in the suction chamber 35 is higher than the predetermined value, the diaphragm 47 is displaced and the gas feed passage 44 is closed. The discharge capacity of the compressor can be adjusted when the crank chamber pressure Pc is controlled by the control valve 46. That is, in the case where the pressure in the suction chamber 35 is low, the degree of opening of the control valve 46 is increased, and the crank chamber pressure Pc is increased, so that the inclination angle of the swash plate 25 (the angle formed between the plane, which is perpendicular to the drive shaft 16, and the swash plate 25)

is decreased, and a stroke of each piston 31 is decreased. Accordingly, the discharge capacity is decreased. On the other hand, in the case where the pressure in the suction chamber 35 is high, the degree of opening of the control valve 46 is decreased, and the crank chamber pressure Pc is decreased, so that the inclination-angle of the swash plate 25 is increased, and a stroke of each piston 31 is increased. Accordingly, the discharge capacity is increased.

In this connection, the maximum inclination angle of the swash plate 25 is restricted when a stopper 25*a* provided on the swash plate 25 comes into contact with the lug plate 24. On the other hand, the minimum inclination angle of the swash plate 25 is restricted when the return spring 30 is fully contracted so that the return spring 30 can not be moved in the direction in which the inclination angle of the swash plate 25 is decreased.

Next, explanations will be made regarding a refrigerant gas suction control means arranged in the suction passage 36. As shown in FIGS. 1 to 3, there is provided an opening and closing valve 49 in the rear housing 13 at a position opposite to the opening end of the suction path 36, for opening and closing the suction path 36. The opening and closing valve 49 includes a cylindrical case or valve housing 50 having a bottom, a valve element 51 accommodated in the case 50 under the condition that a portion of the valve element 51 protrudes from the opening 50*a*, and a spring 52 for urging the valve element 51 onto the valve open side. The diameter of the forward end of the valve element 51 is small, and the spring 52 is arranged around the small diameter section. The valve element 51 is arranged in such a manner that the valve element 51 can be moved forward and back on the extended line of the suction passage 36, and a pressure chamber 53 is arranged on the opposite side to the suction path 36 with respect to the valve body 51. That is, the rear housing 13 has a wall 13*a* with an inner surface 13*b*, and the end portion of the suction passage 36 is formed as a port extending through the wall 13*a* and opening at the inner surface 13*b*. The valve element 51 is arranged to face the inner surface 13*b* and is movable in the direction perpendicular to the inner surface 13*b*. When the discharged refrigerant gas is supplied from the discharge chamber 34 into the pressure chamber 53, the valve element 51 is moved, against the urging force of the spring 52, to the closing position where the suction passage 36 is hermetically closed.

The opening and closing valve 49 is arranged in a hole 54 having a step portion formed in the wall of the rear housing 13, which separates the discharge chamber 34 from the suction chamber 35, in such a manner that the forward end portion of the case 50 protrudes into the suction chamber 35.

In the rear housing 13, there is provided a first passage 55 connecting the pressure chamber 53 to the discharge chamber 34. At a bottom section of the case 50, there is provided a communicating passage 56 connecting the pressure chamber 53 to the first passage 55. A second passage 57 is branched from the first passage 55 at the middle of the passage 55, and leads to the crank chamber 15. An electromagnetic opening and closing valve 58 is arranged in the first passage 55 on the discharge chamber 34 side with respect to the branch point of the second passage 57. In the second passage 57, there is provided a check valve 59 (shown in FIGS. 1 and 3) which allows refrigerant gas to flow toward the crank chamber 15 side. The suction control means is composed as follows. When the air conditioner is operated, the electromagnetic opening and closing valve 58 is kept in a closed condition, and when the air conditioner is stopped, the electromagnetic opening and closing valve 53 is kept in an open condition. Due to the electromagnetic opening and closing valve 58 and the check valve 59, when refrigerant gas is supplied from the discharge chamber 34 into the pressure chamber 53, and the refrigerant gas is also supplied into the crank chamber 15 via the second passage 57, and when the supply of the refrigerant gas to the pressure chamber 53 is stopped, the communication of the crank chamber 15 with the first passage 55 is shut off.

In this connection, the pressure chamber 53 and the suction chamber 35 are connected to each other by a hole 60 extending through the case 50, which is provided for releasing refrigerant gas from the pressure chamber 53 into the suction chamber 35 when the electromagnetic opening and closing valve 58 is shut off. Instead of forming the hole 60, refrigerant gas may be released from the pressure chamber 53 into the suction chamber 35 via a clearance formed between the valve element 51 and the case 50.

As shown in FIG. 3, the respective values are set so that the following relation can be established, wherein the cross-sectional area of the end portion of the suction passage 36 opposing to the valve element 51 is A0, the cross-sectional area of the pressure chamber 53 is A1, the pressure in the suction chamber 36 is Ps when the piston 31 conducts a compressing motion under the condition that the suction passage 36 is tightly closed, the pressure in the discharge chamber 34 is Pd, the pressure in the pressure chamber 53 and the pressure in the first passage 55 from the pressure chamber 53 to the electromagnetic opening and closing valve 58 is P1, the pressure in the suction chamber 35 is Psc, the pressure in the crank chamber 15 is Pc, and the spring force of the spring 52 is F0.

$$A1 \cdot P1 > A0 \cdot Ps + (A1 - A0) \cdot Psc + F0 \quad (1)$$

Next, the operation of the compressor 10 composed as described above will be explained below.

When the air conditioner operation switch is turned on, the electromagnetic opening and closing valve 58 is kept in the closed state (in the "off" state). Therefore, the compressor 10 is operated under the condition that the valve element 51 of the opening and closing valve 49 is located at the open position. Under the above condition, the degree of opening of the capacity control valve 46 is adjusted according to the refrigerating load, so that the communicating condition (opening degree) of the gas supply passage 44 between the discharge chamber 34 and the crank chamber 15 is changed. Under the condition that the refrigerating load is heavy and the pressure in the suction chamber 35 is high, the degree of opening of the capacity control valve 46 is decreased, so that the pressure in the crank chamber 15 is reduced and the inclination angle of the swash plate 25 is increased. The stroke of the piston 31 is thus increased, that is, the compressor 10 is operated under a large displacement condition. Under the condition that the refrigerating load is light and the pressure in the suction chamber 35 is low, the degree of opening of the capacity control valve 46 is increased, so that the pressure in the crank chamber 15 is increased and the inclination angle of the swash plate 25 is decreased. The stroke of the piston 31 is thus decreased, that is, the compressor 10 is operated under a small displacement condition.

On the other hand, in winter, that is, when it is unnecessary to operate the compressor 10 and the air conditioner operation switch is turned off, the electromagnetic opening and closing valve 58 is kept in an open state (in an "on" state), and the discharged refrigerant gas is supplied from the discharge chamber 34 into the pressure chamber 53 via the first passage 55 and the communicating passage 56. The valve element 51 is moved to the closed position shown in FIGS. 1 and 3 against the urging force of the spring 52. At the closed position, the forward end surface of the valve element 51 comes into contact with the surface 13*b* of the wall 13*a* around the opening of the suction passage 36 and covers the suction passage 36. Therefore, the suction passage 36 is completely tightly or hermetically closed. Accordingly, no refrigerant gas flows through the suction passage 36 into the compressor 10 from the external refrigerant circuit 37, and no refrigerant gas flows out from the discharge port 38 into the external refrigerant circuit 37.

A portion of the refrigerant gas supplied from the discharge chamber 34 into the first passage 55 is supplied into the crank chamber 15 via the second passage 57. Since the refrigerating load is light in this state, the suction control valve 46 is kept in the open state, and the refrigerant gas is sucked from the suction chamber 35 into the pressure chamber 33 and compressed by the compressing motion of the pistons 31 and discharged into the discharge chamber 34. A portion of the thus discharged refrigerant gas is supplied into the crank chamber 15 via the first passage 55 and the second passage 57 and is circulated within the compressor 10 via the gas extraction passage 45 and the passage returning to the suction chamber 35.

When the suction passage 36 is tightly closed, the pressure in each portion can be expressed as follows.

$$Pd=Ps>P1>Pc>Psc \quad (2)$$

The reason why the pressure P1 in the pressure chamber 53 is lower than the pressure in the discharge chamber 34 is that pressure loss is caused when the refrigerant gas passes through the electromagnetic opening and closing valve 58. The reason why the pressure Pc in the crank chamber 15 is lower than the pressure P1 is that pressure loss is caused when the refrigerant gas passes through the check valve 59.

When the air conditioner operation switch is turned on so as to restart the operation of the air conditioner which had been turned off, the electromagnetic opening and closing valve 58 is closed, and the supply of the discharge gas from the discharge chamber 34 into the pressure chamber 53 is stopped. When the supply of the discharged refrigerant gas is stopped, the pressure in the pressure chamber 53 is released via the hole 60, and the valve element 51 is moved to the open position by the urging force of the spring 52. In this way, the compressor is normally operated.

The following effects can be provided in this embodiment.

(1) In the case where it is unnecessary to cool the compartment, the suction passage 36 for introducing the refrigerant gas from the external refrigerant circuit 37 is tightly closed by the opening and closing valve 49, and the circulation of refrigerant gas from the compressor 10 to the external refrigerant circuit 37 is completely shut off. As a result, even if the compressor 10 is continuously operated at the minimum displacement state, the evaporator 41 in the external refrigerant circuit 37 is not frozen, and it is possible to prevent a lack of lubricant in the compressor 10.

(2) The second passage 57 is provided, which is branched from the first passage 55 connecting the pressure chamber 53 of the opening and closing valve 49 to the discharge chamber 34 and leading to the crank chamber 15, and the electromagnetic opening and closing valve 58 is provided on the upstream side of the second passage 57 and the check valve 59 is provided in the second passage 57. Accordingly, when the discharge gas is supplied into the pressure chamber 53, the discharged refrigerant gas can be supplied through the second passage 57 into the crank chamber 15, and when the supply of the discharge gas into the pressure chamber 53 is stopped, the communication of the crank chamber 15 with the first passage 55 can be shut off by a simple structure.

(3) The opening and closing valve 49 is arranged at a position opposed to the end of the suction passage 36, the valve element 51 is arranged on the extension line of the suction passage 36 in such a manner that the valve element 51 can be moved toward and away from the surface 13*b*. The valve element 51 is moved to the closed position when the discharged refrigerant gas is introduced into the pressure chamber 53 arranged on the opposite side to the suction passage 36. Accordingly, a clearance, which is provided for moving the valve element 51 in the casing 50, is not related to a portion of the valve which closes the suction passage 36, and therefore, the suction passage 36 can be tightly closed with a simple structure.

(4) since the opening and closing valve 49 has the spring 52 for urging the valve element 51 to the open side, when the supply of the discharged refrigerant gas into the pressure chamber 53 is stopped, the opening and closing valve 49 can be opened by the action of the spring 52. As a result, when the air conditioner is turned on and the compressor is operated, no suction pressure loss is caused.

(5) Since the opening and closing valve 49 is constructed in one unit, it can be easily incorporated in the rear housing 13.

In this connection, the present invention is not limited to the above specific embodiment, for example, the following embodiments may be adopted.

Figure 4:
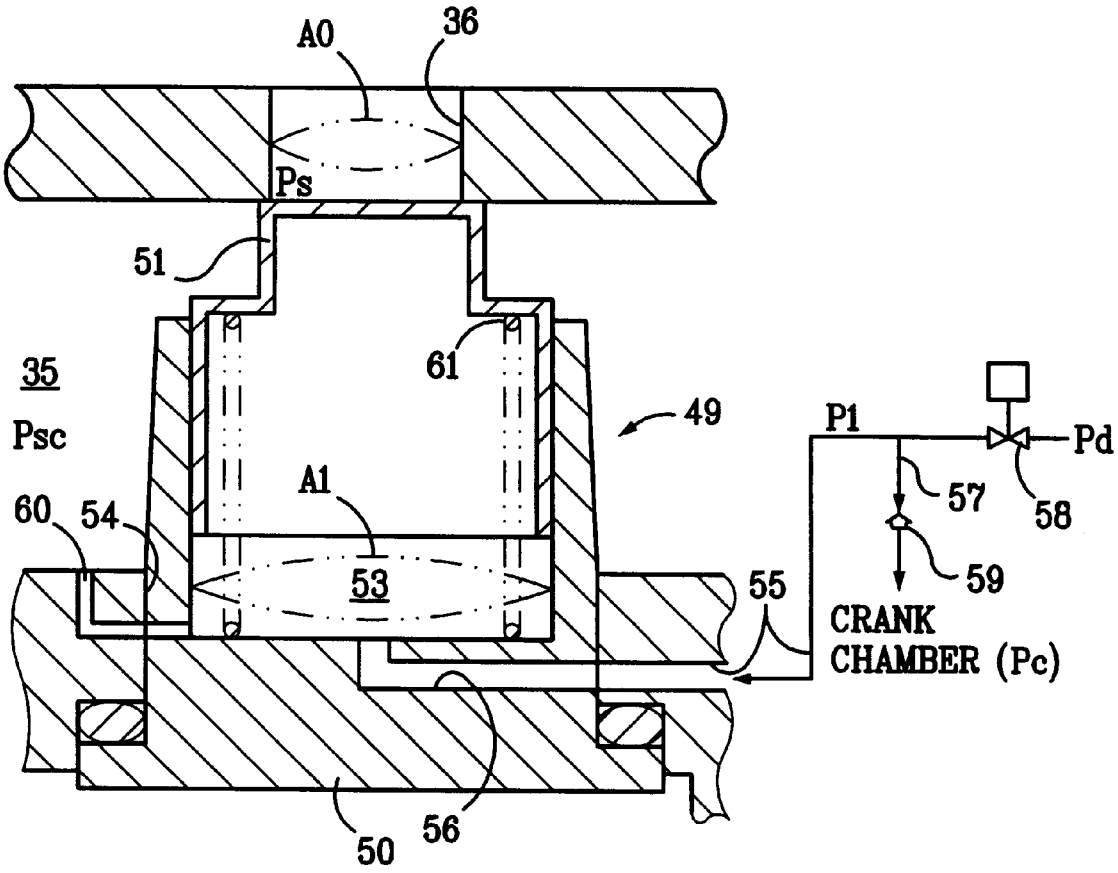
FIG. 4 is a cross-sectional view showing the suction control valve of another embodiment.

As shown in FIG. 4, the opening and closing valve 49 may have a spring 61 for urging the valve element 51 onto the valve closing side (closed side). In this structure, the values of portions are set so that the following relation can be established. In this connection, reference characters of this embodiment are the same as those of the above embodiment.

$$A1 \cdot P1+F0>A0 \cdot Ps+(A1-A0) \cdot Psc \quad (3)$$

In this structure, the spring 61 is used for urging the valve element 51 onto the valve closing side. Therefore, even if the pressure P1 in the pressure chamber 53 is low, the suction passage 36 can be tightly closed. Accordingly, even if the pressure difference (Pd−Psc) in the case of turning off the air conditioner is small, that is, even if the "off" capacity is small, the suction passage 36 can be kept in the tightly closed state.

It is possible to use a structure other than the combination of the electromagnetic opening and closing valve 58 and the check valve 59 as a suction control means allowing the supplying of the discharge gas through the second passage 57 into the crank chamber 15 when the discharge gas is supplied to the pressure chamber 53 and shutting off the communication of the crank chamber 15 with the first passage 55 when supply of the discharge gas to the pressure chamber 53 is stopped. For example, an electromagnetic valve is provided in the second passage 57 instead of the check valve 59, so that when the electromagnetic opening and closing valve 58 is opened, the electromagnetic valve is opened, and when the electromagnetic opening and closing valve 58 is closed, the electromagnetic valve is closed. Alternatively, a three-way valve may be arranged in the branch portion of the second passage 57, without providing the electromagnetic opening and closing valve 58 and the check valve 59. In this case, the three-way valve may be operated to change over between a state in which the discharge chamber 34 is communicated with the pressure chamber 53 and the crank chamber 15 and a state in which the discharge chamber 34, the pressure chamber 53 and the crank chamber 15 cannot be communicated with each other.

Figure 5:
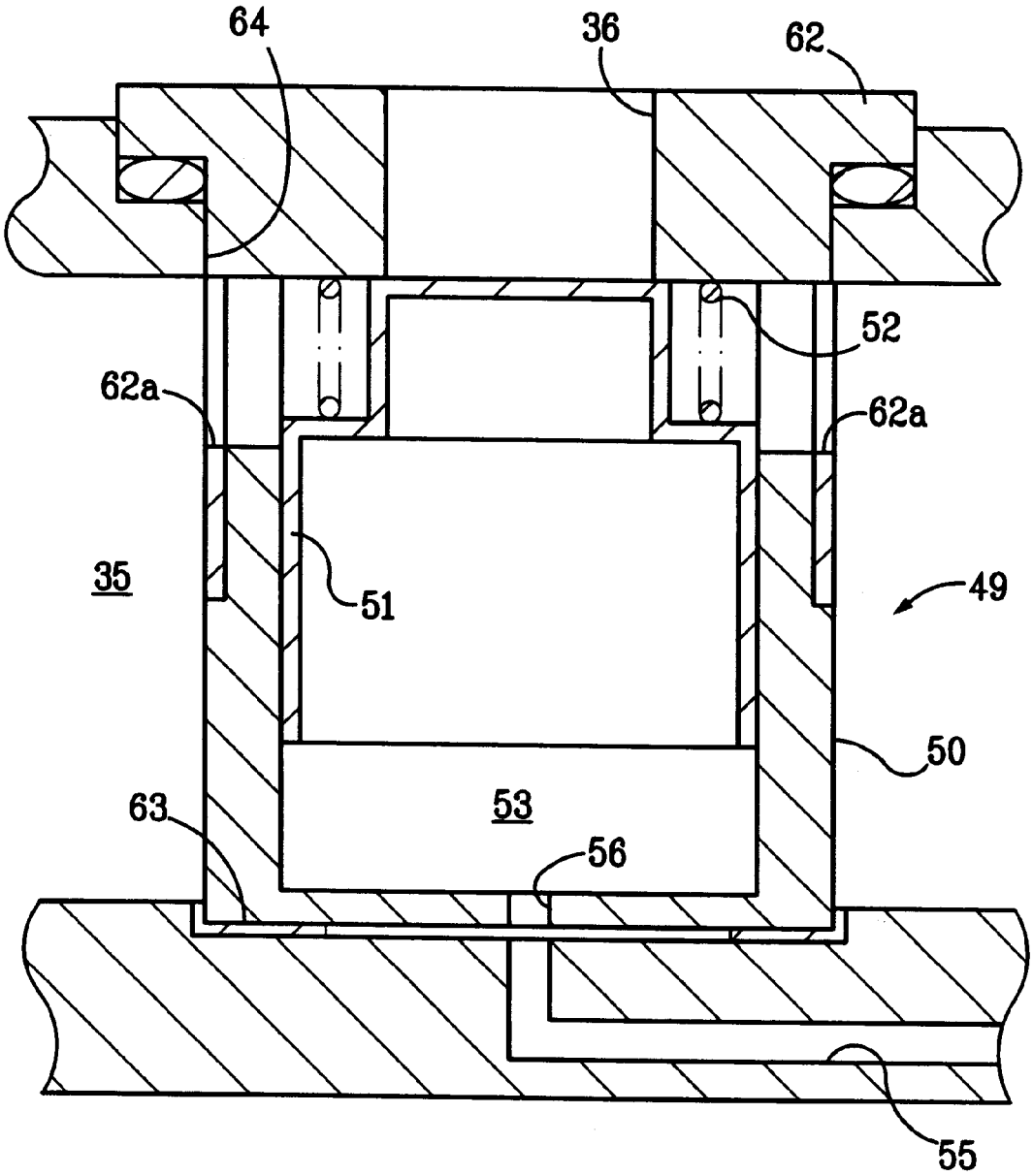
FIG. 5 is a cross-sectional view showing the flow control valve of another embodiment.
Figure 6:
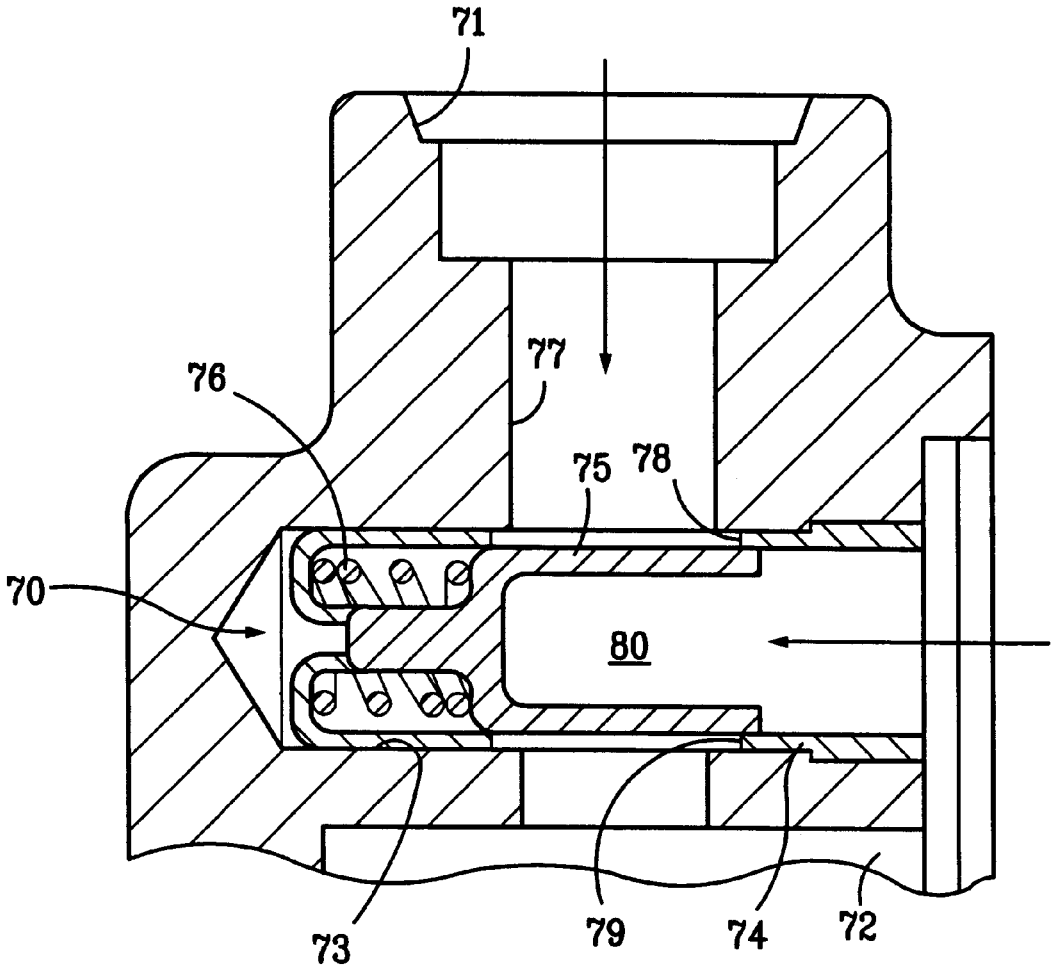
FIG. 6 Prior Art
FIG. 6 is a cross-sectional view showing a part of a compressor of the prior art.

As shown in FIG. 5, it is possible to adopt a structure in which the suction passage 36 is formed integrally with the opening and closing valve 49, and the opening and closing valve 49 is inserted into the suction chamber 35 from the outside of the rear housing 13. In this opening and closing valve 49, the suction passage 36 is formed in a cover 62 which covers the opening section of the case 50, and a through-hole 62*a* is formed at a position opposing to the position at which the spring 52 is arranged. The case 50 is arranged in such a manner that the case 50 comes into contact with the wall of the rear housing 13 which separates the discharge chamber 34 from suction chamber 35, via a packing 63. In this case, when the opening and closing valve 49, which is formed in one unit, is engaged with and fixed to a hole 64 formed in the rear housing 13 from the outside of the rear housing 13, the opening and closing valve 49 can be assembled in the compressor more easily than the embodiment described before.

The opening and closing valve 49 may be composed in such a manner that the valve element 51 is accommodated in an accommodating section formed in the housing, instead of the one unit structure in which the valve element 51 is accommodated in the case 50.

An external control valve may be arranged as the suction control valve 46 for adjusting the pressure in the crank chamber 15, instead of the pressure sensitive mechanism (diaphragm 47) which detects the suction pressure and is displaced and also instead of what is called an internal control valve for adjusting the degree of opening of the gas feed path 44 at least between the discharge chamber 34 and the crank chamber 15 by the displacement of the pressure sensitive mechanism. For example, the external control valve realizes a change in the setting pressure in such a manner that an actuator such as an electromagnetic solenoid, the urging force of which can be electrically adjusted, is added to the internal control valve, so that a mechanical spring force acting on the pressure sensitive member to determine the setting pressure of the internal control valve can be changed by an external control. An example of the external control valve is disclosed in Japanese Unexamined Patent Publication No. 10-141221. The content thereof is incorporated herein by reference.

The structure of the compressor 10 is not limited to one in which the suction chamber 35 is formed into an annular profile 50 that the suction chamber 35 surrounds the discharge chamber 34. It is possible to use a structure in which the suction chamber is provided at the center of the rear housing and the discharge chamber is formed in an annular profile so that the discharge chamber surrounds the suction chamber.

Concerning the mechanism which converts a rotational motion of the drive shaft 16 into a reciprocating motion of the pistons 31 in a variable displacement type compressor, it is possible to apply the present invention to a variable displacement type compressor using a swinging swash plate (wobble plate) which is not rotated with the drive shaft but conducts a swinging motion.

The variable displacement type compressor can include an internal displacement control valve as a displacement control means for controlling pressure in the crank chamber and changing the discharge displacement. In this case, even if a temperature sensor and others are not provided, the pressure in the crank chamber can be automatically adjusted according to a refrigerating load.

As described above in detail, according to the present invention, the evaporator in the external refrigerant circuit is not frozen and, further, a lack of lubricant in the compressor can be prevented even if the compressor is continuously operated in the minimum displacement state.

What is claimed is:

1. A variable displacement type compressor comprising:

a housing having cylinder bores, a crank chamber, a suction chamber and a discharge chamber formed therein;

a suction passage for introducing refrigerant gas from an outer refrigerant circuit into the suction chamber;

a discharge passage for discharging refrigerant gas from the discharge chamber to the outer refrigerant circuit;

pistons slidably arranged in the cylinder bores;

a drive shaft extending through the crank chamber;

a cam plate mounted on the drive shaft for rotation with the drive shaft and for tiltable motion with respect to the drive shaft and operatively coupled to the pistons to convert the rotation of the drive shaft into the reciprocating motion of the pistons;

a pressure control device for controlling the pressure in the crank chamber to change an inclination angle of the cam plate to change the displacement of the compressor;

a first valve arranged in the suction passage for opening and closing the suction passage, the first valve having a valve element, a pressure chamber applying a pressure to the valve element, and a spring urging said valve element in the valve closing direction, said first valve being arranged such that said valve element can hermetically close the suction passage when the refrigerant gas is introduced into said pressure chamber, wherein when said first valve is closed, refrigerant gas lubricating oil is prevented from dissipating through said suction passage and therefore maintained within the compressor;

a first passage for introducing the refrigerant gas from the discharge chamber into the pressure chamber;

a second passage branched from the first passage at a branch point and leading to the crank chamber; and a control device arranged such that the refrigerant gas can be introduced from the second passage into the crank chamber when the refrigerant gas is introduced from the discharge chamber into the pressure chamber and that the flow of the refrigerant gas from the crank chamber to the first passage is blocked when the introduction of the refrigerant gas from the discharge chamber into the pressure chamber is stopped.

2. The variable displacement type compressor according to claim 1, wherein said control device comprises an electromagnetic valve arranged in the first passage between the branch point and the discharge chamber and a check valve arranged in the second passage.

3. The variable displacement type compressor according to claim 1, wherein said housing has a wall having a surface and a port formed through said wall and opening at said surface, said port constituting a portion of said suction passage, said valve element of said first valve being arranged to face said surface and movable in the direction perpendicular to said surface, said pressure chamber being arranged on the side of said valve element remote from said surface of said wall.

4. The variable displacement type compressor according to claim 3, wherein said first valve includes a valve housing in which said valve element is slidably arranged, said valve element having a front end extending from said valve housing and abutting against said surface of said wall when said first valve is in the closed position, said valve element having a back end arranged in said valve housing, said pressure chamber being formed by said back end of the valve element and said valve housing.

5. The variable displacement type compressor according to claim 4, wherein said first valve is arranged in said suction chamber.

6. The variable displacement type compressor according to claim 5, wherein said valve housing has a leak passage connecting said pressure chamber to the suction chamber through said valve housing.

7. The variable displacement type compressor according to claim 1, wherein said first valve includes a spring urging said valve element in the valve opening direction.

8. The variable displacement type compressor according to claim 1, wherein said pressure control device includes a third passage extending from at least one of said discharge chamber and said suction chamber to the crank chamber and a capacity control valve arranged in said third passage.

9. The variable displacement type compressor according to claim 1, wherein said valve element is movable in the direction along the flow in said suction passage.

10. A variable displacement type compressor comprising:

a housing having cylinder bores, a crank chamber, a suction chamber and a discharge chamber formed therein;

a suction passage for introducing refrigerant gas from an outer refrigerant circuit into the suction chamber;

a discharge passage for discharging refrigerant gas from the discharge chamber to the outer refrigerant circuit;

pistons slidably arranged in the cylinder bores;

a drive shaft extending through the crank chamber;

a cam plate mounted on the drive shaft for rotation with the drive shaft and for tiltable motion with respect to the drive shaft and operatively coupled to the pistons to convert the rotation of the drive shaft into the reciprocating motion of the pistons;

a pressure control device for controlling the pressure in the crank chamber to change an inclination angle of the cam plate to change the displacement of the compressor;

a first valve arranged in the suction passage for opening and closing the suction passage, the first valve having a valve element and a pressure chamber applying a pressure to the valve element, said first valve being arranged such that said valve element can hermetically close the suction passage when the refrigerant gas is introduced into said pressure chamber;

a first passage for introducing the refrigerant gas from the discharge chamber into the pressure chamber;

a second passage branched from the first passage at a branch point and leading to the crank chamber; and a control device arranged such that the refrigerant gas can be introduced from the second passage into the crank chamber when the refrigerant gas is introduced from the discharge chamber into the pressure chamber and that the flow of the refrigerant gas from the crank chamber to the first passage is blocked when the introduction of the refrigerant gas from the discharge chamber into the pressure chamber is stopped;

wherein said housing has a wall having a surface and a port formed through said wall and opening at said surface, said port constituting a portion of said suction passage, said valve element of said first valve being arranged to face said surface and movable in the direction perpendicular to said surface, said pressure chamber being arranged on the side of said valve element remote from said surface of said wall; and wherein said first valve includes a valve housing in which said valve element is slidably arranged, said valve element having a front end extending from said valve housing and abutting against said surface of said wall when said first valve is in the closed position, said valve element having a back end arranged in said valve housing, said pressure chamber being formed by said back end of the valve element and said valve housing.

11. The variable displacement type compressor according to claim 10, wherein said first valve includes a spring urging said valve element in the valve closing direction.

12. The variable displacement type compressor according to claim 10, wherein said control device comprises an electromagnetic valve arranged in the first passage between the branch point and the discharge chamber and a check valve arranged in the second passage.

13. The variable displacement type compressor according to claim 10, wherein said first valve includes a spring urging said valve element in the valve opening direction.

14. The variable displacement type compressor according to claim 10, wherein said first valve is arranged in said suction chamber.

15. The variable displacement type compressor according to claim 14, wherein said valve housing has a leak passage connecting said pressure chamber to the suction chamber through said valve housing.

16. The variable displacement type compressor according to claim 10, wherein said pressure control device includes a third passage extending from at least one of said discharge chamber and said suction chamber to the crank chamber and a capacity control valve arranged in said third passage.

* * * * *